United States Patent [19]

Yamamoto et al.

[11] Patent Number: 4,737,679

[45] Date of Patent: Apr. 12, 1988

[54] IMPREGNATED CATHODE

[75] Inventors: Shigehiko Yamamoto, Tokorozawa; Sadanori Taguchi, Nishitama; Toshiyuki Aida, Chofu; Isato Watanabe, Hachioji; Susumu Kawase, Higashimurayama, all of Japan

[73] Assignee: Hitachi, Ltd., Tokyo, Japan

[21] Appl. No.: 826,339

[22] Filed: Feb. 5, 1986

[30] Foreign Application Priority Data

Feb. 8, 1985 [JP] Japan ..... 60-23084

[51] Int. Cl.[4] ..... H01J 19/06; H01J 1/14; H01K 1/04

[52] U.S. Cl. ..... 313/346 R; 313/352; 313/630; 313/633; 313/635; 428/336; 428/472; 428/701

[58] Field of Search ..... 313/346 R, 352, 630, 313/633, 635; 428/336, 472, 701

[56] References Cited

U.S. PATENT DOCUMENTS

| | | | |
|---|---|---|---|
| 3,155,864 | 11/1964 | Coppola | 313/346 R |
| 4,291,252 | 9/1981 | Aida et al. | 313/346 R |
| 4,369,392 | 1/1983 | Hotta et al. | 313/346 R |
| 4,518,890 | 5/1985 | Taguchi et al. | 313/346 R |
| 4,570,099 | 2/1986 | Green | 313/346 R |
| 4,594,220 | 6/1986 | Hasker et al. | 313/346 R |
| 4,626,470 | 12/1986 | Yamamoto et al. | 428/336 |

FOREIGN PATENT DOCUMENTS

| | | | |
|---|---|---|---|
| 0019922 | 10/1980 | European Pat. Off. . | |
| 0091161 | 10/1983 | European Pat. Off. | 313/346 R |
| 2072559 | 6/1977 | Japan | 313/346 R |
| 0086729 | 5/1985 | Japan | 313/346 R |
| 0138822 | 7/1985 | Japan | 313/346 R |
| 0170137 | 9/1985 | Japan | 313/346 R |

OTHER PUBLICATIONS

Lemmens et al., "A New Thermonic Cathode for Heavy Loads," *Philips Technical Review*, No. 12, Jun. 1950, pp. 341–372.

Yamamoto et al., "Electron Emissive Properties and Surface Atom Behavior of an Impregnated Cathode Coated with Tungsten Thin Film Containing $Sc_2O_3$," *Japan Journal of App. Phy.*, vol. 25, No. 7, Jul. 1986, pp. 971–975.

*Primary Examiner*—David K. Moore
*Assistant Examiner*—Michael J. Nickerson
*Attorney, Agent, or Firm*—Antonelli, Terry & Wands

[57] ABSTRACT

The present invention relates to an impregnated cathode produced by attaching at least two layered thin films, the thin films comprising an under layer consisting of a high melting point metal thin film composed of, for example, Os, Ru, Rh, Pd, Ir, Pt, Re, Mo, W, Ta, etc., and an over layer consisting of a high melting point metal layer which contains $Sc_2O_3$ and which is placed over the layer, on the surface of the impregnated cathode pellet generated by impregnating a refractory porous base body with electron emissive materials. The invention relates also to an electron tube having this cathode. This cathode maintains a low work functional mono-layer stably for a long period of time on its surface.

17 Claims, 1 Drawing Sheet

IMPREGNATED CATHODE

BACKGROUND OF THE INVENTION

The present invention relates to an impregnated cathode and an electron tube, especially a display tube and a pick up tube, using said impregnated cathode, and further to a cathode having a low work function mono-layer required for a particular low temperature operation on a cathode surface and an electron tube using said cathode.

The impregnated cathode formerly used for a low temperature operation is, as indicated in the Japanese Patent Application Laid Open No. 154131/1983, characterized in that it has a constitution of a porous base body consisting of W and $Sc_2O_3$ impregnated with electron emissive materials; also it has a mono-layer consisting of Ba, Sc, and O on the cathode surface; and it forms a low work function surface. However, this mono-layer is defective in the following respects that: it is unstable against thermal shock or ion bombardment; it is short in life because of its non-uniform distribution, and also its electron emissive property deteriorates at a low electric field.

SUMMARY OF THE INVENTION

An object of the present invention is to provide an impregnated cathode which has a mono-layer of the low work function maintained stably for a longer period and which has uniform work function on the cathode surface. Another object of the present invention is to provide an electron tube using this cathode.

These objects are achieved by an impregnated cathode and an electron tube using this cathode, wherein this cathode is featured in that it is structured by attaching at least two layered thin films, i.e., an under layer consisting of a high melting point metal thin film and an over layer consisting of a high melting point metal layer which contains $Sc_2O_3$ and is placed over said under layer, on the surface of the impregnated cathode pellet prepared by impregnating a refractory porous base body with electron emissive materials.

DETAILED DESCRIPTION OF PREFERRED EMBODIMENTS

The present invention has proposed a cathode newly structured so as to form a mono-layer which is stable against thermal shock or ion bombardment and is uniform, by using the conventional standard type impregnated cathode (which is made up by impregnating a refractory porous base body with electron emissive materials) for a Ba supply source, by attaching the high melting point metal thin film on the cathode surface so as to smoothen the surface, and by attaching the high melting point metal thin film containing $Sc_2O_3$ even over the surface as a Sc and O supply source.

The mono-layer consisting of Ba, Sc and O on the conventional cathode surface is formed by combining $Sc_2O_3$, showing no reaction against the electron emissive materials at the time of impregnation, with Ba diffusing out of pores in a porous base body, thereby showing no existence once a supply of $Sc_2O_3$ discontinues. In addition, non-reactive $Sc_2O_3$ remains a very small quantity, thus being difficult to control.

In the present invention, a high melting point metal thin film containing $Sc_2O_3$ such as a thin film of at least one metal selected from the group consisting of W, Mo, Ta, Ir. Os, Re, Ru, Rh, Pd, and Pt is employed as a supply source of $Sc_2O_3$ and the film is desirable to have a thickness of 10 nm to 1 $\mu$m.

The above-said standard type impregnated cathode surface to work as under layer has pores 5 $\mu$m diameter on average. If the above-stated metal thin film is directly formed on this surface, there will be caused some inconveniences, for example, a supply of Ba tends to concentrate on the pores directly under the thin film and the thin film is not likely to be evenly formed. This invention provides an under thin film layer under said metal thin film so as to prevent such inconveniences. A high melting point metal thin film is enough for this under layer, however it is desirable to adopt at least one metal which is selected from the high melting point noble metals such as Os, Re, Pt, Ru, etc. showing low reactivity against the electron emissive materials.

It is also proper to provide micro pores or cracks artificially controlled in this under layer thin film, allowing a structure to easily diffuse Ba onto the over layer thin film. It is recommendable to provide 10 nm to 2 $\mu$m for the small pore diameter or for the crack width, also ranging preferably from 10 nm to 1 $\mu$m.

For the Ba source, materials capable of supplying Ba like a pressed cathode can also be used in addition to the above-mentioned standard type impregnated cathode.

Figure 1:
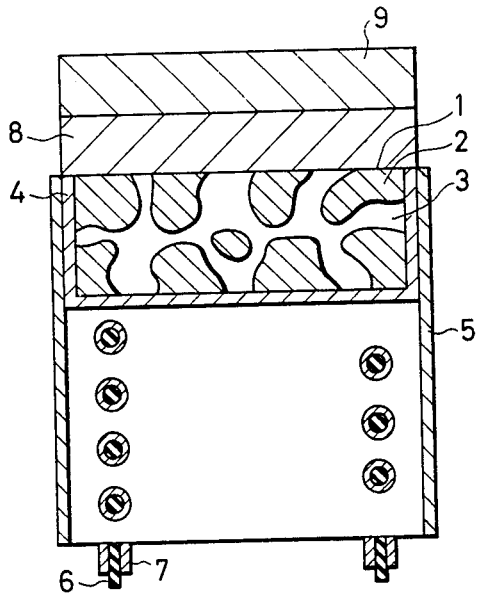
FIG. 1 shows a schematically illustrated cross section of the impregnated cathode in an embodiment of this invention.

The following is a description of one of the typical examples of the present invention as shown in FIG. 1.

FIG. 1 is a cross section which schematically illustrates the impregnated cathode in this invention. In this illustration, numeral 1 denotes a pellet of 1.4 mm diameter of the cathode base body materials and is structured of porous tungsten base body 2 prepared by impregnating pore 3 having porosity of from 20 to 25% with the electron emissive materials. The electron emissive materials mixed with $BaCO_3$, $CaCO_3$, and $Al_2O_3$ at a mole ratio of 4:1:1 are used. It is also proper to use materials mixed at a different mole ratio or to which different substances are added. It is also suitable to use the porous base body of Mo, Ta, Re, Ru, Rh, Pd, Os, Ir, Pt besides W, or an alloy of such substances.

First, a Ta cup 4 is plugged with the pellet 1 and then the Ta cup 4 is laser welded on the upper part inside Ta sleeve 5. Instead of laser welding, soldering is also recommended. Cathode pellet 1 is heated by heater 7 which is core wire 6 coated with alumina and provided in the lower part inside Ta sleeve 5. Such is the standard type impregnated cathode, serving as the Ba source. The Ba supply amount depends on the temperature at which cathode pellet 1 is heated, however it can also be adjusted by altering mole ratios in the composition of the above electron emissive materials or by containing such activators as Zr, Hf, Ti, Cr, Mn, Si, and Al in said base body material.

An Os layer approx. 500 nm in thickness is attached, adopting electron beam bombardment heating, as high melting point metal thin film 8 which is provided on the pellet 1 surface. For the materials to form this film, noble metals like Ru, Rh, Pd, Ir, Pt, Re in addition to Os; high melting point metals like Mo, W, and Ta; and an alloy of these substances can also be used. A thickness of 10 nm to 1 μm is appropriate for the film. The $Sc_2O_3$ source is made up by attaching thin film 9 consisting of W and $Sc_2O_3$ and having 10 nm to 1 μm, thick, employing the vacuum sputtering method. Instead of W, it is also appropriate to use Mo, Re, Ru, Rh, Pd, Os, Ir, Pt, and Ta or an alloy of these substances. 10 weight % is opted for the content of $Sc_2O_3$ in W in this case, and it is recommended to select a range from 1 to 50 weight %.

Figure 2:
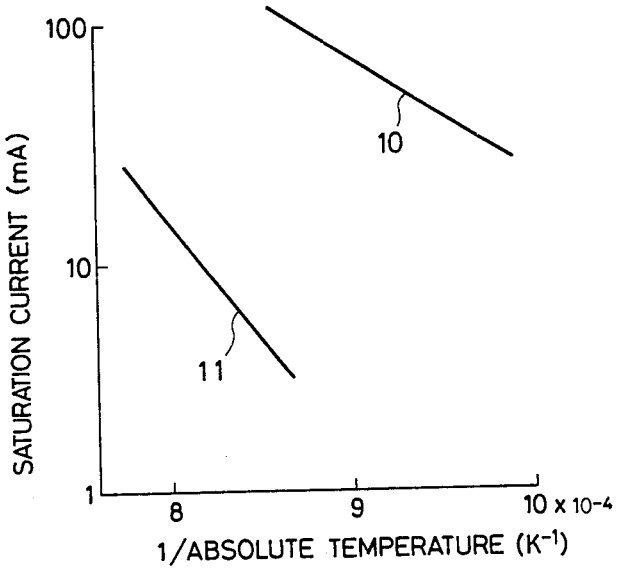
FIG. 2 is a graph comparing the electron emissive properties between the cathode in the present invention and the conventional low temperature operation impregnated chathode.

By using the cathode like this, saturation current density is measured by applying high voltage pulse 5 μs wide and at a repetition cycle of 100 Hz to an anode with a cathode/anode diode configuration. The result of this is shown in FIG. 2. Numeral 10 in the figure denotes the emission characteristics of the cathode which contains 10 weight % of $Sc_2O_3$ and which has W thin film 9 about 100 nm thick and Os thin film 8 approx. 500 nm thick. The conventional cathode having no thin films 8 and 9 mentioned above is identical to characteristic 10, however, the characteristic degrades as illustrated by numeral 11 after removal of mono-layer consisting of Ba, Sc and O due to sputtering at Ar atmosphere of $5\times10^{-5}$ Torr. Whereas the cathode in this invention produces nearly no electron emissive deterioration subsequent to the mono-layer removal and restores characteristic 10 when heated at 1150° C. for a period of 15 min in case the cathode shows any deterioration. The cathode, in addition, has remarkably improved electron emission characteristics under low electric field as compared with a cathode having no smoothing treatment film.

It is obvious from what has been described that the present invention has effects that if the mono-layer consisting of Ba, Sc and O which are all essential to maintain a low work functional condition is destroyed, there can be observed no deterioration in the electron emission characteristic because a mono-layer is newly supplied. And if there should be deterioration in the characteristic, the cathode forms a complete mono-layer if only heated at about 1150° C. for roughly 15 to 30 min, thus maintaining its characteristics of a long service life and a low temperature operation.

Further, since smoothing treatment by the high melting point metal thin film improves deterioration in the electron emission under the low electric field, application to various electron tubes like normal display tubes has created low temperature operational effects.

What is claimed is:

1. An impregnated cathode which is prepared by attaching at least two layered thin films, said at least two layered thin films comprising an under layer thin film consisting of a high melting point metal and an over layer thin film consisting of a high melting point metal and $Sc_2O_3$ and being placed over said under layer thin film, on the surface of an impregnated cathode pellet formed by impregnating a refractory porous base body with electron emissive materials, said under layer thin film forming a smooth surface over which said over layer thin film is placed.

2. The impregnated cathode according to claim 1, wherein the metal of said high melting point metal thin film is at least one metal selected from the group consisting of W, Mo, Ta, Re, Ru, Rh, Pd, Os, Ir, and Pt.

3. The impregnated cathode according to claim 1 or 2, wherein the thickness of said under layer is 10 nm to 1 μm, while that of said over layer ranges from 10 nm to 1 μm.

4. The impregnated cathode according to claim 1, wherein said high melting point metal has small pores or cracks smaller than an average diameter of pores in said refractory porous base body and the diameter of said small pores or the width of the cracks is within the range from 10 nm to 2 μm.

5. An electron tube which has an impregnated cathode, prepared by attaching at least two layered thin films, said at least two layered thin films comprising an under layer thin film consisting of a high melting point metal, and an over layer thin film consisting of a high melting point metal and $Sc_2O_3$ and which is placed over said under layer thin film, on an impregnated cathode pellet surface produced by impregnating a refractory porous base body with electron emissive materials, said under layer thin film forming a smooth surface over which said over layer thin film is placed.

6. The electron tube according to claim 5, wherein said under layer has a thickness of 10 nm to 1 μm, whereas said over layer has a thickness of 10 nm to 1 μm.

7. Am impregnated cathode comprising:

a refractory porous base body impregnated with at least one electron emissive material;

an under layer comprising a thin film made of a high melting point metal on the surface of said refractory porous base body; and an over layer comprising a thin film made of a high melting point metal and $Sc_2O_3$ over said under layer, said under layer forming a smooth surface over which said over layer is provided.

8. An impregnated cathode according to claim 7, wherein said refractory porous base body is impregnated with $BaCO_3$, $CaCO_3$, and $Al_2O_3$.

9. An impregnated cathode according to claim 8, wherein the mole ratio of $BaCO_3$:$CaCO_3$:$Al_2O_3$ is 4:1:1.

10. An impregnated cathode according to claim 7, wherein said refractory porous base body is made of at least one material selected from the group consisting of W, Mo, Ta, Re, Ru, Rh, Pd, Os, Ir and Pt.

11. An impregnated cathode according to claim 7, wherein said refractory porous base body is made of tungsten.

12. An impregnated cathode according to claim 7, wherein said under layer is made of at least one material selected from the group consisting of Os, Ru, Rh, Pd, Ir, Pt, Re, Mo, W, and Ta.

13. An impregnated cathode according to claim 7, wherein said under layer is made of Os.

14. An impregnated cathode according to claim 7, wherein said over layer is made of $Sc_2O_3$ and at least one material selected from the group consisting of W, Mo, Re, Ru, Rh, Pd, Os, Ir, Pt and Ta.

15. An impregnated cathode according to claim 14, wherein said over layer contains 1 to 50 weight % $Sc_2O_3$.

16. An impregnated cathode according to claim 7, wherein the thickness of said under layer is 10 nm to 1 μm, and the thickness of said over layer is from 10 nm to 1 μm.

17. An impregnated cathode according to claim 7, wherein said under layer has small pores or cracks therein, said small pores or cracks being smaller than an average diameter of pores in said refractory porous base body, the diameter of said small pores of the width of said cracks being 10 nm to 2 μm.

* * * * *